United States Patent [19]

Lindbloom

[11] Patent Number: 4,461,505

[45] Date of Patent: Jul. 24, 1984

[54] SUSPENDED LOAD ROTATING LIFTER

[75] Inventor: George G. Lindbloom, Allison Park, Pa.

[73] Assignee: White Consolidated Industries, Inc., Cleveland, Ohio

[21] Appl. No.: 363,410

[22] Filed: Mar. 30, 1982

[51] Int. Cl.[3] ..... B66C 1/04

[52] U.S. Cl. ..... 294/88; 414/626; 414/783

[58] Field of Search ..... 294/88, 65.5, 86 R, 294/67 DA, 86 LS, 104; 414/783, 626, 420, 744 R, 754, 638, 740, 741, 743, 747

[56] References Cited

U.S. PATENT DOCUMENTS

| | | | |
|---|---|---|---|
| 1,042,307 | 10/1912 | Babb . | |
| 3,670,912 | 6/1972 | Dunbar | 214/313 |
| 3,805,969 | 4/1974 | Bilocq | 214/1 R |
| 4,044,894 | 8/1977 | McDonald et al. | 414/626 |
| 4,368,815 | 1/1983 | Kvasnicka | 414/783 |

*Primary Examiner*—James B. Marbert

*Attorney, Agent, or Firm*—Buell, Blenko, Ziesenheim & Beck

[57] ABSTRACT

The invention comprises a load-supporting beam provided with plates at each end which are pivotally mounted to pendants at each end, to which pendants are attached the suspending cables. Each pendant carries a hydraulic cylinder attached at one end to the pendant and at the other end to a crank affixed to the rotating element carrying the pivot for the load. That element is provided with an indexing pin which fits movably in a slot in the adjoining beam end plate. That end plate also has a second slot in line with the slot first mentioned, through which second slot passes the pivot bolt which also passes through the center of rotation of the rotating member. The center of gravity of the rotating load carrier is brought into alignment with the axis of rotation by adjusting the position of the indexing pin and the pivot bolt in the end plate slots.

4 Claims, 5 Drawing Figures

SUSPENDED LOAD ROTATING LIFTER

This invention relates to suspended apparatus for lifting heavy elongated loads and rotating them about a longitudinal axis. It is more particularly concerned with such apparatus which may be adjusted to bring the center of gravity of the entire suspended rotating assembly into alignment with its axis of rotation.

BACKGROUND OF THE INVENTION

In the handling of elongated, heavy loads such as steel concrete invert form sections, which may be as much as 30 feet long and weigh 14 tons or more, or similar loads, it is often necessary to rotate the loads around a longitudinal axis. In the case of the above mentioned forms, rotation must be effected through an angle of 110° to allow the form section to pass between the legs of the form carrier. To maintain full control of the load during such rotation, it would, of course, be desirable to rotate it around an axis coaxial with its center of gravity. However, a unitary lifting apparatus must include a beam long enough to accommodate the longest load contemplated to which beam the suspending and rotating members are attached at its ends and load latching means positioned intermediate its ends. The desired center of gravity is thus not that of the load alone, but of the entire rotating assembly of load and beam. This center of gravity changes, of course, from load to load. My apparatus to be described hereinafter is adjustable to bring the center of gravity of the entire rotatable assembly into alignment with its axis of rotation.

SUMMARY OF THE INVENTION

My invention comprises a load-supporting beam provided with plates at each end which are pivotally mounted to pendants at each end, to which pendants are attached the suspending cables. Each pendant carries a hydraulic cylinder attached at one end to the pendant and at the other end to a crank affixed to the rotating element carrying the pivot for the load. That element is provided with an indexing pin which fits movably in a slot in the adjoining beam end plate. That end plate also has a second slot in line with the slot first mentioned, through which second slot passes the pivot bolt which also passes through the center of rotation of the rotating member. The center of gravity of the rotating load carrier is brought into alignment with the axis of rotation by adjusting the position of the indexing pin and the pivot bolt in the end plate slots.

DESCRIPTION OF PREFERRED EMBODIMENT

Figure 1:
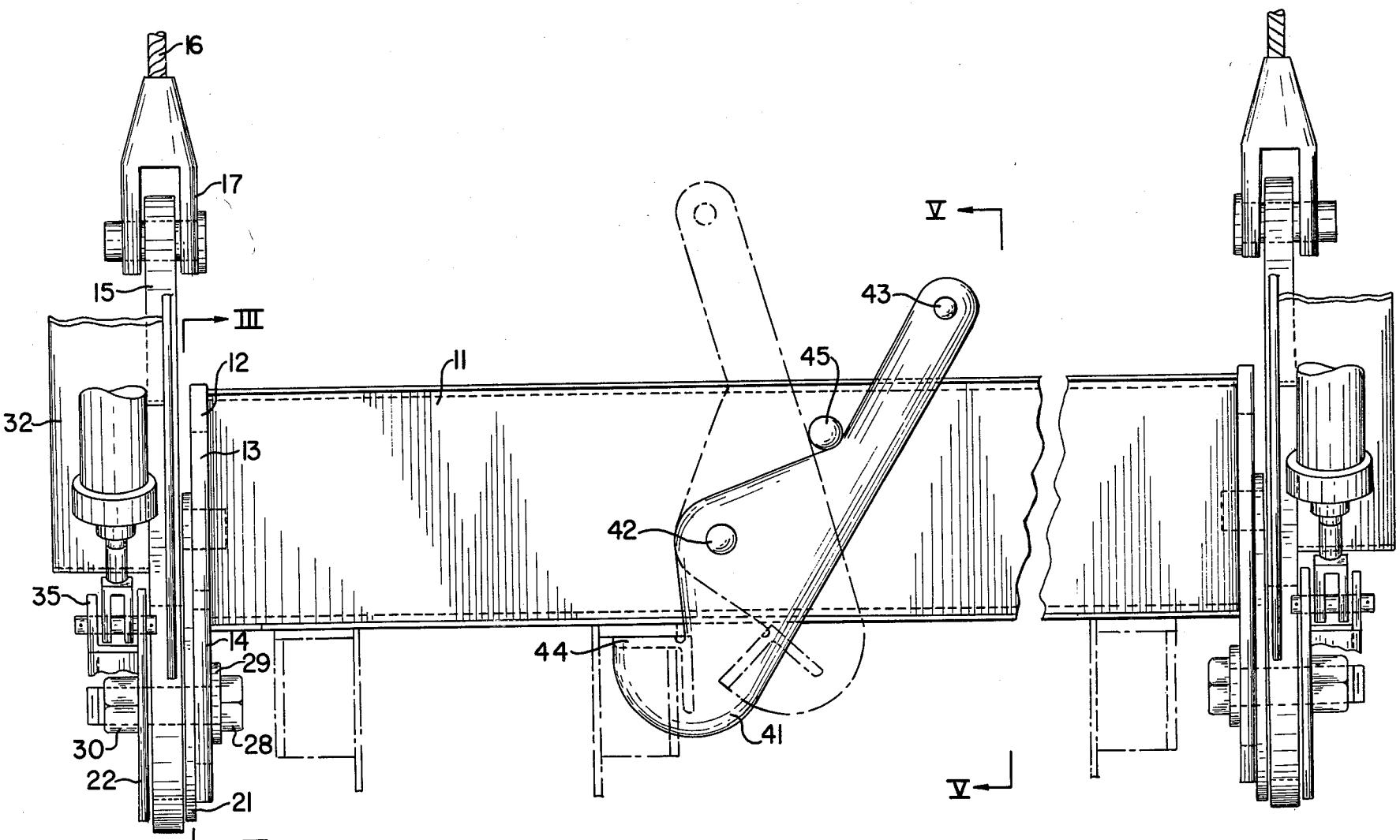
FIG. 1 is a side elevation of my apparatus.
Figure 2:
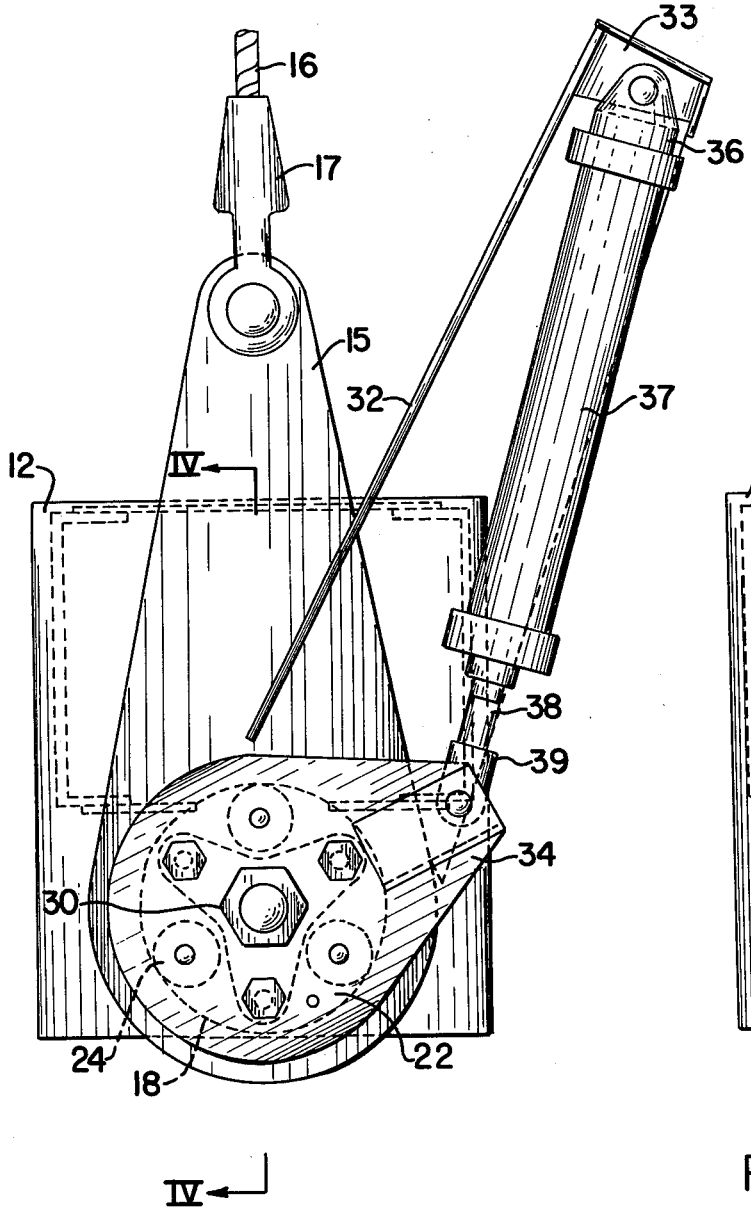
FIG. 2 is an end elevation of the apparatus of FIG. 1.
Figure 3:
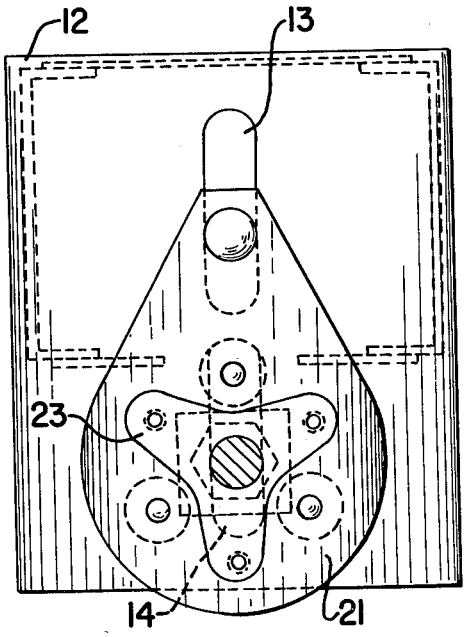
FIG. 3 is a cross section taken on the plane III—III of FIG. 1.
Figure 4:
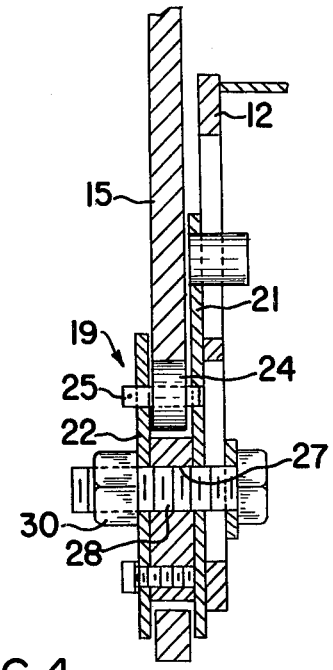
FIG. 4 is a cross section taken on the plane IV—IV of FIG. 2.
Figure 5:
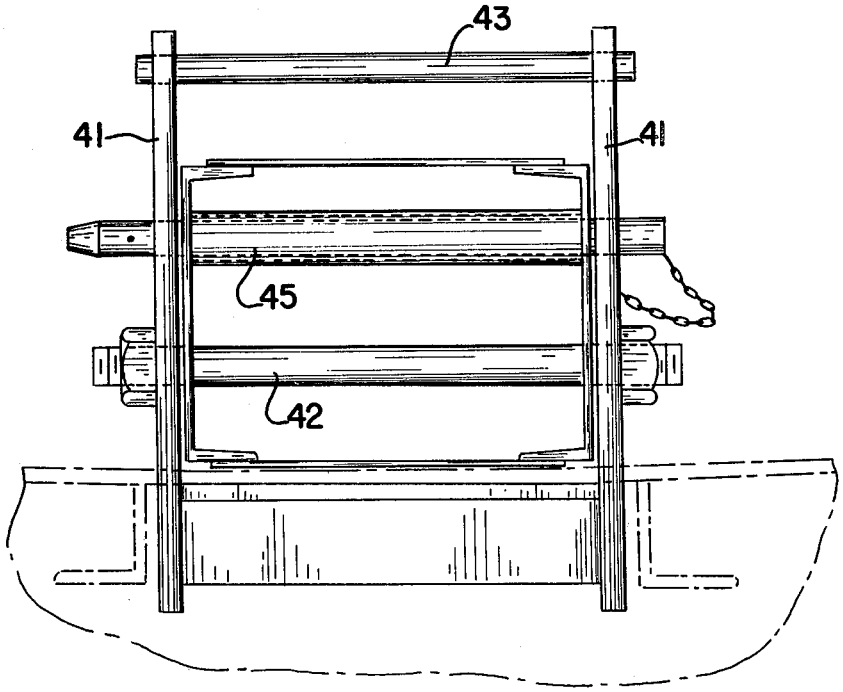
FIG. 5 is a cross section taken on the plane V—V of FIG. 1.

The load is carried by elongated load carrying box beam 11 shown in FIG. 1. To each end of beam 11 is affixed a flat plate 12 which is fabricated with an upper vertical slot 13 and a lower vertical slot 14 on the vertical center line of the plate. Each plate 12 is connected to a pendant 15 in a manner to be described hereinafter. Each pendant 15 is connected at its upper end with a lifting cable 16 through a clevis and pin 17. The lower end of each pendant 15 is formed with a circular cut-out 18. In this cut-out is fitted a rotatable member 19 comprising inside end plate 21, outside plate 22, and central spider 23 to which both end plates are attached. Three rollers 24 are mounted on pivot shafts 25 between end plates 21 and 22 so as to roll in circular cut-out 18 between the legs of spider 23. At this center, spider 23 is formed with a hole 27 for a pivot bolt 28 which passes through washer 29, slot 14 and end plate 12, and plates 21, 22 and spider 23 and is held in place by nut 30.

Attached to pendant 15 is arm 32 which extends upwardly and outwardly thereof and terminates at its upper end in bracket 33. Outer end plate 22 if formed with projecting crank arm 34 which carries a clevis 35. Double-acting hydraulic cylinder 37 is connected to bracket 33 by a clevis 36 at its closed end and to clevis 35 of arm 34 by end 39 of its piston rod 38.

The load is attached to beam 11 by a latch comprising side plates 41 joined at their upper ends by cross rod 43, and straddling beam 11. Plates 41 pivot on pin 42 which passes through beam 11 and are locked with jaws 44 at their lower ends against the load by pin 45 which is passed through holes in beam 11.

In operation the load is balanced by field adjustment. To effect this balance, one end of each cylinder 37 is disconnected from its connecting member. Pivot bolts 28 are temporarily tightened against nuts 30 in position. The load is then lifted slightly and the direction in which it tilts or rotates is noted. It is then returned to ground and bolts 28 are loosened and adjusted up or down in slots 14 to compensate for unbalance, each bolt being moved to the same relative position. The load is again lifted slightly to test for balance. When the balance point is found washers 29 are then welded in place to plates 12. Cylinders 37 are reconnected. By admitting hydraulic fluid to one end or the other of the two cylinders simultaneously, the load can be rotated through an angle as great as 110° under full control.

I claim:

1. Cable supported apparatus for lifting elongated loads and rotating them about a longitudinal axis comprising a beam, a latching mechanism carried by the beam for attaching an elongated load thereto, a pendant suspended by a cable positioned adjacent each end of said beam, a member rotatable within each pendant, means attaching each rotatable member to its adjoining beam end so as to permit vertical adjustment therebetween, and means connected between each said rotatable member and its pendant for rotating that member therein whereby by adjusting the vertical adjustment means the center of gravity axis of the rotating assembly of load and beam coincides with its axis of rotation so that said rotating assembly is balanced.

2. Apparatus of claim 1 in which the means for rotating the rotatable member comprise a bracket affixed to the pendant above the rotatable member, a crank affixed to the rotatable member and a hydraulic cylinder connected between the bracket and the crank.

3. Apparatus of claim 1 in which the means attaching each rotatable member to its adjoining beam end comprise an end plate affixed to the beam and extending below the beam, a pair of vertical slots in said end plate, one above the other, the lower slot extending below the beam, an indexing pin affixed to the rotatable member and projecting into the upper slot in the end plate and a bolt passing through the center of the rotatable member and the lower slot in the end plate.

4. Apparatus of claim 3 in which the rotatable member rotates within a circular cut-out in the pendant and comprises a plate on the inside of the pendant and a plate on the outside of the pendant, a spider within the cut-out affixed to both plates and having a central hole for a pivot bolt, a plurality of rollers positioned between the legs of the spider on pivots carried by the end plates, positioned so that the rollers roll on the inside surface of the circular cut-out, and in which the indexing pin is carried by the plate on the inside of the pendant.

* * * * *

UNITED STATES PATENT AND TRADEMARK OFFICE

CERTIFICATE OF CORRECTION

PATENT NO. : 4,461,505

DATED : July 24, 1984

INVENTOR(S) : GEORGE G. LINDBLOOM

It is certified that error appears in the above-identified patent and that said Letters Patent is hereby corrected as shown below:

Column 2, line 16, change "if" to --is--.

Signed and Sealed this

First Day of January 1985

[SEAL]

*Attest:*

GERALD J. MOSSINGHOFF

*Attesting Officer*

*Commissioner of Patents and Trademarks*